US008755558B2

(12) United States Patent
Saiki

(10) Patent No.: US 8,755,558 B2
(45) Date of Patent: Jun. 17, 2014

(54) SPEAKER, HEARING AID, EARPHONE, AND PORTABLE TERMINAL DEVICE

(75) Inventor: Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 3 days.

(21) Appl. No.: 13/320,825

(22) PCT Filed: Mar. 14, 2011

(86) PCT No.: PCT/JP2011/001464
§ 371 (c)(1),
(2), (4) Date: Nov. 16, 2011

(87) PCT Pub. No.: WO2011/114688
PCT Pub. Date: Sep. 22, 2011

(65) Prior Publication Data

US 2012/0070022 A1 Mar. 22, 2012

(30) Foreign Application Priority Data

Mar. 18, 2010 (JP) ..... 2010-063196

(51) Int. Cl.

| | |
|---|---|
| ***H04R 1/00*** | (2006.01) |
| ***H04R 9/06*** | (2006.01) |
| *H04R 1/10* | (2006.01) |
| *H04R 7/20* | (2006.01) |
| *H04R 25/00* | (2006.01) |

(52) U.S. Cl.
CPC *H04R 9/063* (2013.01); *H04R 1/10* (2013.01); *H04R 1/1016* (2013.01); *H04R 7/20* (2013.01); *H04R 25/00* (2013.01)
USPC ..... 381/398; 381/182; 381/184; 381/186; 381/401; 181/171; 181/172

(58) Field of Classification Search
USPC ..... 381/182, 184, 186, 398, 401; 181/171–172
See application file for complete search history.

(56) References Cited

U.S. PATENT DOCUMENTS 1,930,186 A * 10/1933 Swallow ..... 381/186
4,418,248 A * 11/1983 Mathis ..... 381/373

(Continued)

FOREIGN PATENT DOCUMENTS

JP 60-180200 11/1985
JP 62-47298 2/1987

(Continued)

OTHER PUBLICATIONS

Extended European Search Report issued Aug. 23, 2013 in corresponding European Application No. 11755879.1.

(Continued)

*Primary Examiner* — Curtis Kuntz
*Assistant Examiner* — Ryan Robinson
(74) *Attorney, Agent, or Firm* — Wenderoth, Lind & Ponack, L.L.P.

(57) ABSTRACT

A speaker capable of suppressing deterioration of acoustic efficiency while allowing miniaturization of the speaker includes a first unit and a second unit each of which outputs sound. The first unit includes a diaphragm which vibrates back and forth to radiate sound; and plural suspensions which support, at different positions, an outer periphery of the diaphragm. At least one of air passages for channeling sound from the second unit to the outside is provided between the plural suspensions.

13 Claims, 13 Drawing Sheets

(56) References Cited

U.S. PATENT DOCUMENTS

| | | | | |
|---|---|---|---|---|
| 7,499,555 | B1 * | 3/2009 | Isvan | 381/71.6 |
| 7,567,680 | B2 * | 7/2009 | Murray et al. | 381/181 |
| 7,784,583 | B1 * | 8/2010 | Hall et al. | 181/130 |
| 8,077,898 | B2 * | 12/2011 | Huang | 381/345 |
| 2007/0053540 | A1 | 3/2007 | Harvey | |
| 2008/0226090 | A1 | 9/2008 | Seto | |
| 2008/0317255 | A1 * | 12/2008 | Cozens et al. | 381/71.6 |
| 2009/0279729 | A1 | 11/2009 | Huang | |
| 2011/0044489 | A1 | 2/2011 | Saiki et al. | |

FOREIGN PATENT DOCUMENTS

| | | |
|---|---|---|
| JP | 62-277000 | 12/1987 |
| JP | 63-38493 | 3/1988 |
| JP | 63-200988 | 12/1988 |
| JP | 2-44899 | 2/1990 |
| JP | 3-35693 | 2/1991 |
| JP | 4-347997 | 12/1992 |
| JP | 2005-277792 | 10/2005 |
| WO | 2009/066415 | 5/2009 |

OTHER PUBLICATIONS

International Search Report issued Apr. 19, 2011 in International (PCT) Application No. PCT/JP2011/001464.

* cited by examiner (a)

(b)

(a)

(b)

SPEAKER, HEARING AID, EARPHONE, AND PORTABLE TERMINAL DEVICE

BACKGROUND OF THE INVENTION

I. Technical Field

The present invention relates to a small speaker, particularly an ultra-small speaker called a receiver, and to a device including the small speaker.

II. Description of the Related Art

Along with the popularization of portable music players, recent years have seen heavy use of earphones and headphones for easy music reproduction and enjoyment indoors and outdoors. Furthermore, with the advancement of an aging society, the demand for hearing aids has increased and increased use of receivers, which are ultra-small speakers used in sound reproduction in hearing aids, is expected.

Among earphones intended primarily for such music reproduction or hearing aid receivers, inner ear earphones or receivers which are inserted into the external auditory canal of the ears are widely used. Taking into consideration the wearing comfort of a user, it is preferable that the configuration of such an inner ear earphone or receiver be compact. In particularly, for hearing aids that a user wears in the ears for prolonged periods over the course of everyday life, there is a strong demand for small receivers that are hardly felt by the user when worn.

Furthermore, there is a demand for prolonged battery life, particularly in hearing aids, to enable use over extended periods of time. As such, in hearing aids, it is important to suppress the power consumed by the receiver. In order to suppress power consumption, it is preferable that the acoustic efficiency of the receiver be increased to allow sufficient sound volume to be obtained even with low power. However, speaker miniaturization and improvement of acoustic efficiency often contradict each other, and thus, generally, the size of a speaker becomes big when attempting to increase the acoustic efficiency of the speaker.

As one conventional technique for solving this problem, there is a speaker described in Unexamined Japanese Patent Application Publication Number 2-44899. FIG. 13 is a structural cross-sectional view of a conventional speaker described in Unexamined Japanese Patent Application Publication Number 2-44899. As shown in FIG. 13, the conventional speaker includes a first speaker unit 1, a second speaker unit 2, a first chassis 3 which holds the first speaker unit, a second chassis 4 which holds the second speaker unit 2 and the first chassis 3. Inside the speaker, an air passage 5 is formed by the outer periphery of the first chassis 3 and the inner periphery of the second chassis 4.

The first speaker unit includes a diaphragm 6, a suspension 7 which supports the entirety of the outer periphery of the diaphragm 6, a voice coil 8 which is fixed to the diaphragm 6, and a magnetic circuit unit. The magnetic circuit unit includes a yoke 9, a magnet 10, and a plate 11. Furthermore, in the magnetic circuit unit, a magnetic air gap 12 is formed by the inner periphery of the yoke 9 and the outer periphery of the plate 11. The voice coil 8 is held inside the magnetic air gap 12.

The second speaker unit 2 has the same structure as the first speaker unit 1, and thus detailed description shall not be repeated.

The operation of the conventional speaker configured in the manner described above shall be described. The sound generated from a diaphragm 13 of the second speaker unit 2 is radiated to the outside of the speaker via the air passage 5 formed by the outer periphery of the first chassis 3 and the inner periphery of the second chassis 4. On the other hand, the sound generated from the diaphragm 6 of the first speaker unit 1 is directly radiated to the outside of the speaker. As a result, a combined sound of the sound from the first speaker unit 1 and the sound from the second speaker unit 2 which is radiated through the air passage 5 is reproduced.

In this manner, the conventional speaker shown in FIG. 13 achieves miniaturization by arranging two speaker units in series. Specifically, arranging two speaker units on top of each other in the vibration direction of the diaphragms allows for miniaturization of the speaker as a whole compared to when two speakers are arranged in the same plane. Furthermore, since the sounds outputted from the two speakers are combined into one, it is possible to improve acoustic efficiency.

SUMMARY OF THE INVENTION

However, in the above-described conventional speaker, the sound outputted from the second speaker unit 2 is radiated to the outside via the air passage 5. The air passage 5 is provided in an outer periphery further beyond the first chassis 3 supporting the outer periphery of the suspension 7 of the first speaker unit 1. As such, the external dimensions of the first chassis 3 become big in order to secure space for the air passage 5.

Furthermore, the external dimensions of the first speaker unit needs to be made smaller than the external dimensions of the second speaker unit 2. In other words, the surface area of the diaphragm 6 of the first speaker unit 1 becomes smaller than the surface area of the diaphragm 13 of the second speaker unit 2. Therefore, a difference occurs in the sound pressures of the sounds outputted from the two speakers. As a result, even when two speaker units are used, it is difficult to achieve both high acoustic efficiency and miniaturization.

In view of this, the present invention is conceived to solve the above-described problem and has as an object to provide a speaker, and so on, which are capable of suppressing deterioration of acoustic efficiency while allowing miniaturization of the speaker.

In order to achieve the aforementioned object, the speaker according to an aspect of the present invention includes a first unit and a second unit each of which is configured to output sound, wherein the first unit includes: a first diaphragm which vibrates back and forth to radiate sound; and a plurality of suspensions which support an outer periphery of the first diaphragm at mutually different positions, and wherein at least one air passage for channeling sound outputted from the second unit to the outside is provided between the suspensions.

Furthermore, it is preferable that the second unit include a second diaphragm which vibrates back and forth to radiate the sound, and that the first diaphragm and the second diaphragm be arranged in series such that at least part of a membrane surface of one of the diaphragms overlaps with at least part of a membrane surface of the other when seen from a vibration direction of the first diaphragm or the second diaphragm.

Furthermore, it is preferable that the speaker further include an acoustic port through which sound is radiated to the outside, wherein the first unit is disposed between the acoustic port and the second unit, the sound radiated to a front of the first diaphragm is radiated to the outside through the acoustic port, and the sound radiated to a front of the second diaphragm passes through the at least one air passage, and is radiated to the outside through the acoustic port.

Furthermore, it is preferable that: a first sound hole and a second sound hole be formed in the acoustic port; the sound radiated from the first diaphragm be radiated from the first sound hole; and the sound radiated from the second diaphragm be radiated from the second sound hole, via the at least one air passage Furthermore, it is preferable that: a first air chamber be formed in front of the first diaphragm; a second air chamber be formed in front of the second diaphragm; and the first air chamber, the second air chamber, the first sound hole, and the second sound hole be formed such that a first acoustic resonance and a second acoustic resonance have mutually different frequencies, the first acoustic resonance being dependent on an acoustic capacitance of the first air chamber and an acoustic mass of the first air hole, and the second acoustic resonance being dependent on an acoustic capacitance of the second air chamber and an acoustic mass of the second air hole.

Furthermore, it is preferable that the respective vibration directions of the first diaphragm and the second diaphragm be opposite directions.

Furthermore, it is preferable that: each of the first unit and the second unit be an electrodynamic electro-acoustic transducer including a magnetic circuit; and a magnetizing direction of the magnetic circuit of the first unit and a magnetizing direction of the magnetic circuit of the second unit be mutually opposite in the vibration direction of the diaphragms.

Furthermore, it is preferable that the first unit and the second unit be arranged such that a bottom face-side of the magnetic circuit of the first unit and a bottom face-side of the magnetic circuit of the second unit face each other.

Furthermore, it is preferable that the first unit and the second unit be arranged such that the first diaphragm and the second diaphragm face each other.

Furthermore, it is preferable that: a first air chamber be formed in front of the first diaphragm, a second air chamber be formed in front of the second diaphragm, a sound hole be formed in the acoustic port, the sound hole be connected to the first air chamber, and is connected to the second air chamber via the at least one air passage, and the sound radiated to the back of the first diaphragm and the sound radiated to the back of the second diaphragm be radiated in a direction different from a direction of sound radiated from the sound hole.

Furthermore, it is preferable that a magnetic fluid be filled into a magnetic air gap formed in the magnetic circuit of the first unit and into which a voice coil is inserted.

According to the speaker according to an aspect of the present invention, plural suspensions support, at mutually different positions, the outer periphery of the first diaphragm, and thus an air passage can be provided between the plural suspensions. As a result, the need to enlarge the external dimensions of the speaker to accommodate the air passage for channeling the sound outputted from the second unit to the outside is eliminated, and thus a high-efficiency speaker including plural units can be miniaturized.

DETAILED DESCRIPTION OF THE INVENTION

Hereinafter, embodiments of the present invention shall be described with reference to the Drawings.

Embodiment 1

Figure 1:
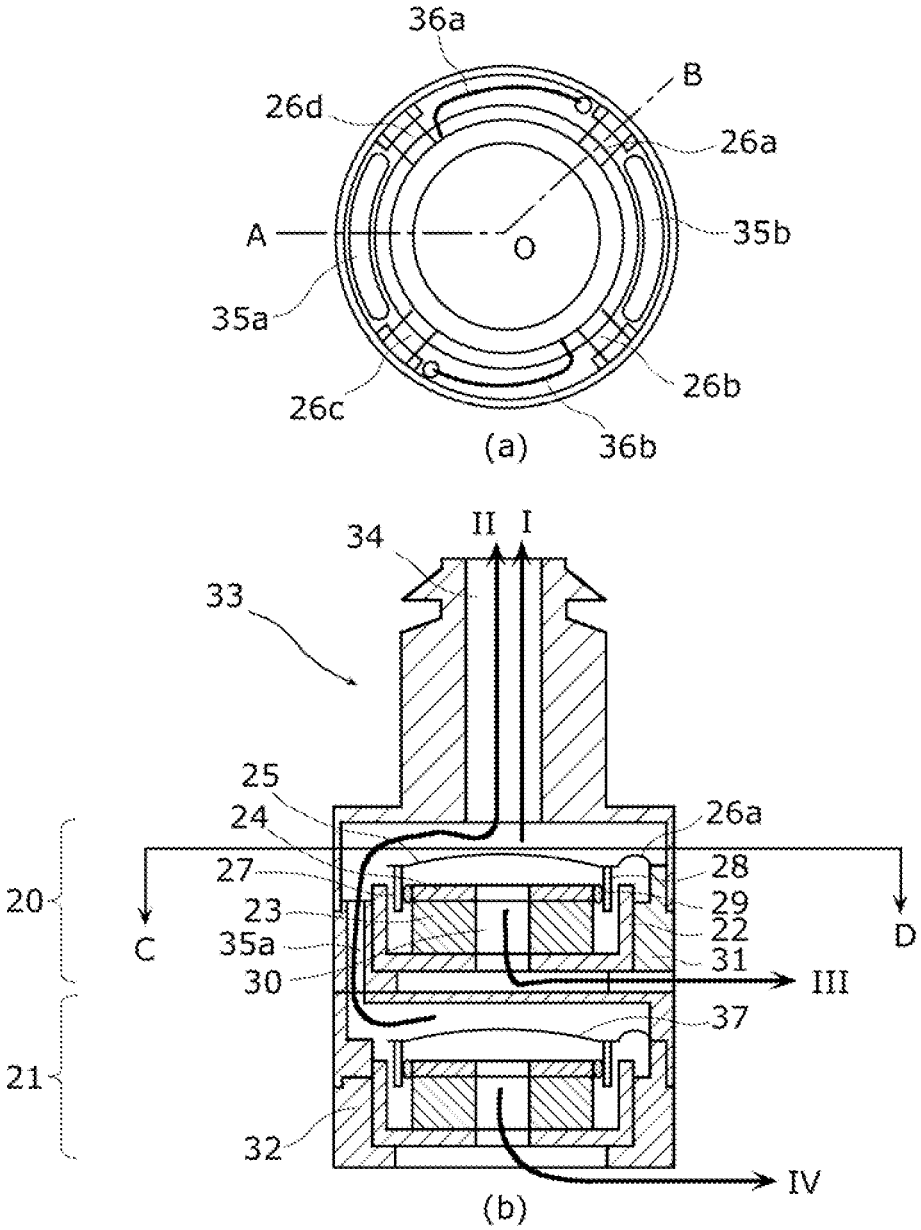
FIG. 1 is a cross-sectional view of a speaker in Embodiment 1 of the present invention.

FIG. 1 is a diagram showing a speaker in Embodiment 1 of the present invention. Specifically, (a) in FIG. 1 is a transverse cross-sectional view of the speaker in the present embodiment. Furthermore, (b) in FIG. 1 is a vertical cross-sectional view of the speaker in the present embodiment. More specifically, (a) in FIG. 1 is a cross-sectional view of the speaker when cut along a line C-D of the vertical cross-sectional view shown in (b) in FIG. 1. Furthermore, (b) in FIG. 1 is a cross-sectional view of the speaker when cut along a line defined by A-O-B shown in the transverse cross-sectional view in (a) in FIG. 1.

As shown in FIG. 1, the speaker in the present embodiment includes a first unit 20, a second unit 21, a first frame 31, a second frame 32, and an acoustic port 33. In the present embodiment, each of the first unit 20 and the second unit 21 is an electrodynamic electro-acoustic transducer including a magnetic circuit.

The first unit 20 is disposed between the acoustic port 33 and the second unit 21. The first unit 20 includes: the magnetic circuit including a yoke 22, a magnet 23, and a plate 24; a diaphragm 25; four suspensions 26*a*, 26*b*, 26*c*, and 26*d*; a voice coil 28; and a magnetic fluid 29.

The magnet 23 is fixed to the inner bottom surface of the yoke 22. Furthermore, the plate 24 is fixed to the top surface of the magnet 23. A magnetic air gap 27 is formed between the yoke 22 and the magnet 23. A sound hole 30 which penetrates through the yoke 22, the magnet 24, and the plate 24 is formed at the center part of the yoke 22, the magnet 24, and the plate 24.

The diaphragm 25 is an example of the first diaphragm which vibrates back and forth to radiate sound. In the present embodiment, the cross-sectional shape of the diaphragm is a convex shape which is convex upward (forward), as shown in (b) in FIG. 1.

The suspensions 26*a*, 26*b*, 26*c*, and 26*d* each support a different position in the outer periphery of the diaphragm 25. Specifically, the suspensions 26*a*, 26*b*, 26*c*, and 26*d* are placed discreetly in the outer periphery of the diaphragm 25. In the present embodiment, the suspensions 26*a*, 26*b*, 26*c*, and 26*d* are placed at uniform intervals in the circumferential direction of the diaphragm 25.

Furthermore, in the present embodiment, the suspensions 26*a*, 26*b*, 26*c*, and 26*d* are formed integrally with the diaphragm 25. In addition, the suspensions 26*a*, 26*b*, 26*c*, and 26*d* are bonded to the top surface part of the frame 31. It should be noted that the diaphragm 25 and the suspensions 26*a*, 26*b*, 26*c*, and 26*d* need not necessarily be formed integrally.

The voice coil 28 is inserted inside the magnetic air gap 27, and fixed to the outer periphery of the diaphragm 25. The diaphragm 25 can be caused to vibrate by applying an electrical signal to the voice coil 28.

The magnetic fluid 29 is filled into a space formed between the inner periphery of the voice coil 28 and the plate 24. The magnetic fluid 29 is held by way of the magnetic force of the magnet 23. In addition, the magnetic fluid 29, through its viscosity, holds the voice coil 28 inside the magnetic air gap 27, and is capable of stably causing the voice coil 28 to vibrate.

The first frame 31 makes up a part of a chassis which houses the first unit 20 and the second unit 21. Furthermore, the first frame 31 holds, in a fixed manner, the magnetic circuit and the outer edges of the suspensions 26*a*, 26*b*, 26*c*, and 26*d* of the first frame 31. Air passages 35*a* and 35*b* are provided in part of regions of the first frame 31 which are disposed between the suspensions 26*a*, 26*b*, 26*c*, and 26*d* when seen from a planar view.

The air passages 35*a* and 35*b* connect a first air chamber formed in front of the diaphragm 25 of the first unit 20 with a second air chamber formed in front of the diaphragm 37 of the second unit 21. Therefore, the sound radiated to the front of the diaphragm 37 of the second unit 21 passes sequentially through the second air chamber, the air passages 35*a* and 35*b*, and the first air chamber, and is radiated to the outside from a sound hole 34 of the acoustic port 33. Specifically, the air passages 35*a* and 35*b* are equivalent to air passages for channeling the sound outputted from the second unit 21, to the outside.

Furthermore, lead wires 36*a* and 36*b* electrically connected to the voice coil 28 are placed in the other part of the regions of the first frame 31 which are disposed between the suspensions 26*a*, 26*b*, 26*c*, and 26*d* when seen from a planar view. An electrical signal is applied to the voice coil 28 via the lead wires 36*a* and 36*b*.

The second unit 21 is disposed below the first unit 20. The second unit 21 includes the diaphragm 37 and so on, in the same manner as in the first unit 20.

The diaphragm 37 is an example of the second diaphragm which vibrates back and forth to radiate sound. In the present embodiment, the shape and size of the diaphragm 37 is the same as those of the diaphragm 25 of the first unit 20.

It should be noted that, as shown in (b) in FIG. 1, the diaphragm 25 included in the first unit 20 and the diaphragm 37 included in the second unit 21 are arranged in series such that at least part of the membrane surface of one of the diaphragms overlaps with the membrane surface of the other when seen from the vibration direction of the diaphragm 25 or the diaphragm 37. In the present embodiment, the diaphragm 25 and the diaphragm 37 are arranged such that the vibration direction of one is parallel to that of the other.

It should be noted that since the second unit 21 has the same configuration as the first unit 20, detailed description of the respective constituent elements thereof shall not be repeated here.

The second frame 32 makes up a part of the chassis which houses the first unit 20 and the second unit 21. Furthermore, the second frame 32 holds, in a fixed manner, the magnetic circuit and the outer edges of the suspensions of the second unit 21.

The acoustic port 33 makes up a part of the chassis which houses the first unit 20 and the second unit 21. The acoustic port 33 is fixed to the top surface of the first frame 31. Specifically, the acoustic port 33 is disposed above the first unit 20. The sound hole 34 is formed in a center part of the acoustic port 33.

The sound hole 34 is connected to the first air chamber formed in front of the diaphragm 25 of the first unit 20. Furthermore, the sound hole 34 is connected to the second air chamber formed in front of the diaphragm 37 of the second unit 21, via the air passages 35*a* and 35*b*.

Next, the operation of the speaker configured in the manner described above shall be described.

When an electrical signal is applied to the voice coil 28 of the first unit 20, the diaphragm 25 vibrates. Then, the sound radiated to the front of the diaphragm 25 by way of the vibration of the diaphragm 25 is radiated from the sound hole 34 of the acoustic port 33 to the outside of the speaker, as indicated by the arrow I in (b) in FIG. 1.

When the same electrical signal as that in the voice coil 28 of the first unit 20 is also applied to the voice coil of the second unit 21, the diaphragm 37 vibrates. Then, the sound radiated to the front of the diaphragm 37 by way of the vibration of the diaphragm 37 passes through the air passages 35*a* and 35*b*, and is radiated from the sound hole 34 of the acoustic port 33 to the outside of the speaker, as indicated by the arrow II in (b) in FIG. 1.

At this time, the sound radiated to the front of the diaphragm 37 of the second unit 21 is combined, inside the speaker, with the sound that is radiated to the front of the diaphragm 25 of the first unit 20 indicated by arrow I. Therefore, the combined sound of the sound outputted from the first unit 20 and the sound outputted from the second unit 21 is radiated from the sound hole 34 of the acoustic port 33 to the outside.

Figure 13:
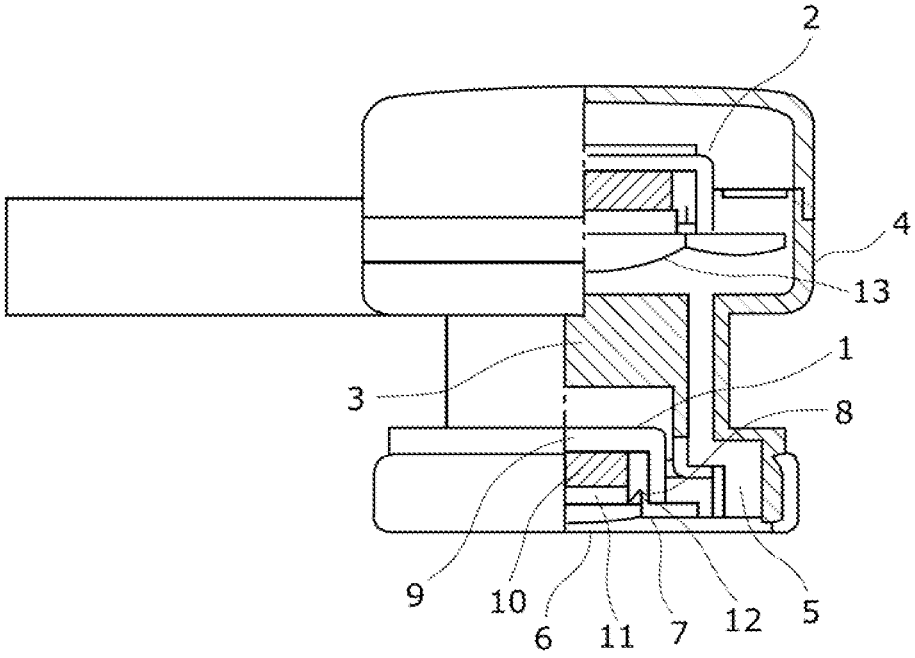
FIG. 13 is a cross-sectional view of a structure of a conventional speaker.

In this manner, the sound outputted from the second unit 21 is radiated to the outside by passing through the air passages 35*a* and 35*b* provided between the suspensions of the first unit 20. As such, since the speaker in the present embodiment is provided with air passages for channeling the sound outputted from the second unit 21 to the outside, the external dimensions of the first unit 20 do not need to be enlarged. In other words, the speaker in the present embodiment allows further miniaturization than the conventional speaker shown in FIG. 13.

Furthermore, since the speaker in the present embodiment includes two units having respective diaphragms of the same shape and size, acoustic efficiency can be improved compared to a speaker provided with only one unit. For example, when the input electrical energy is the same, the speaker in the present invention is capable of improving the output acoustic level by 3 db compared to a speaker provided with only one unit. Furthermore, when the output acoustic level is the same, the speaker in the present invention allows input electrical energy to be halved compared to a speaker provided with only one unit.

In other words, the speaker in the present embodiment allows simultaneous realization of miniaturization and reduced power consumption. In other words, the speaker in the present embodiment is capable of suppressing deterioration of acoustic efficiency while allowing miniaturization of the speaker.

In addition, in the present embodiment, each of the diaphragms is supported by plural suspensions. As such, the stiffness of each suspension can reduced more than when the entirety of the outer periphery of a diaphragm is supported by one suspension; and thus the fundamental resonance frequency of the unit can be lowered. As a result, the speaker in the present embodiment, though small, is capable of reproducing sound of relatively low frequencies.

Furthermore, in the present embodiment, the magnetic fluid 29, which is stably supported by the magnetic flux of the magnetic air gap 27, is filled into the inner periphery of the voice coil 28. Therefore, the magnetic fluid 29, through its viscosity, is capable of stably supporting the diaphragm 25 and the voice coil 28. Furthermore, the magnetic fluid 29 is also capable of suppressing heat generation by the voice coil 28, and is also capable of preventing the voice coil 28 from burning out when a large electrical signal is inputted.

In addition, the sound radiated to the back of the diaphragm 25 of the first unit 20 is prevented from passing through to the front of the diaphragm 25, by the magnetic fluid 29 which is filled into the magnetic air gap 27 between the inner periphery of the voice coil 28 and the outer periphery of the plate 24. As such, the sound radiated to the back of the diaphragm 25 is radiated to the outside by passing through the sound hole 30, as indicated by the arrow III in (b) in FIG. 1, without passing through the magnetic air gap 27 and leaking to the front of the diaphragm 25. In the same manner, the sound radiated to the back of the diaphragm 37 of the second unit 21 is also radiated to the outside as indicated by arrow IV in (b).

In this manner, in the speaker in the present embodiment, the sounds radiated to the front of the respective diaphragms of the first unit 20 and the second unit 21 (arrows I and II), and sounds which are of opposite phase to the forward-radiated sounds and are radiated to the back of the diaphragms (arrows III and IV) are simultaneously radiated to the outside. However, when the speaker is to be used in a hearing aid or an earphone, the sounds radiated to the front of the diaphragms (arrows I and II) are radiated into the external auditory canal, and the sounds radiated to the back of the diaphragms (arrows III and IV) are radiated towards the outside of the external auditory canal, and thus there is practically no interference between the sounds.

It should be noted that, in order to prevent the sounds radiated to the back of the diaphragms from being radiated to the outside, the back of the diaphragms may be sealed. However, in this case, it is necessary to consider that the fundamental resonance frequency of the units will rise due to the air stiffness of the enclosure at the back of the diaphragms, and thus the limit for low frequency reproduction will rise.

Furthermore, although, in the present embodiment, the diaphragm 37 of the second unit 21 is also supported by plural suspensions in the same manner as in the first unit 20, the diaphragm 37 need not necessarily be supported by plural suspensions. There is no need to provide, the second unit 21 with an air passage for channeling the sound outputted from the other unit, to the outside. Therefore, the suspension included in the second unit 21 may be a suspension having an annular shape that is continuously connected in the circumferential direction of the diaphragm 37.

In addition, although the speaker in the present embodiment includes two units, three or more units may be provided. In such a case, it is preferable that the three or more units be arranged in series vertically. At this time, it is sufficient that an air passage be provided between plural suspensions in each of the units other than the lowermost unit. With this configuration, the sounds outputted from three or more units are combined, and thus a small speaker having an even higher efficiency than the conventional speaker can be realized.

Embodiment 2

Next, Embodiment 2 of the present invention shall be described.

A significant difference between a speaker in the present embodiment and the speaker in Embodiment 1 described earlier lies in the arrangement direction of the two units. In Embodiment 1, the positional relationship of the magnetic circuit and the diaphragm with respect to the emission direction of the sound radiated from the acoustic port is the same for the first unit and the second unit. In other words, in Embodiment 1, in both the first unit and the second unit, the diaphragm and the magnetic circuit are arranged in sequence from the acoustic port-side.

On the other hand, in Embodiment 2, the two units are arranged such that the magnetic circuits are opposed. Specifically, the first unit and the second unit are arranged such that the bottom face of the magnetic circuit of the first unit and the bottom face of the magnetic circuit of the second unit face each other. Stated differently, the diaphragms are arranged to be vertically symmetrical.

Specifically, in the speaker in Embodiment 1, the first unit and the second unit are arranged toward the same direction, whereas in speaker in Embodiment 2, the first unit and the second unit are arranged facing opposing directions.

Hereinafter, the speaker in Embodiment 2 shall be described with reference to the Drawings.

Figure 2:
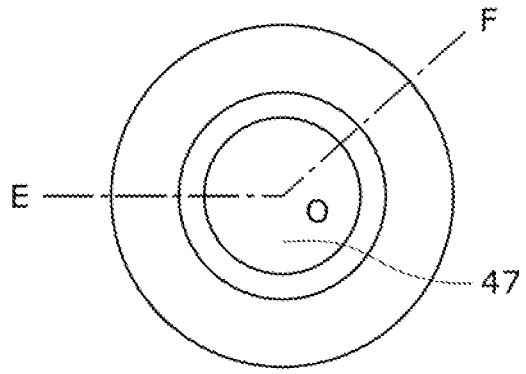
FIG. 2 is a plan view and a cross-sectional view of a speaker in Embodiment 2 of the present invention.
Figure 2:
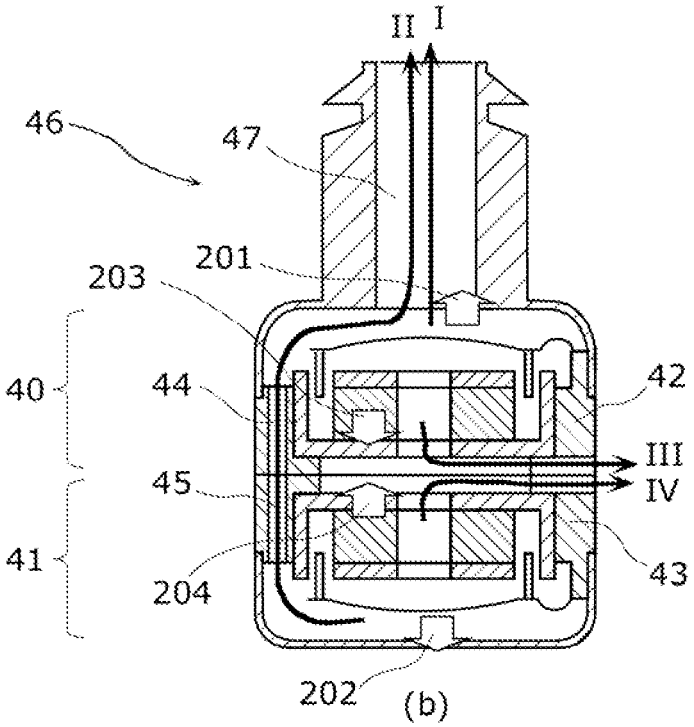

FIG. 2 is a diagram showing the speaker in Embodiment 2 of the present invention. Specifically, (a) in FIG. 2 is a plan view of the speaker in the present embodiment. Furthermore, (b) in FIG. 2 is a vertical cross-sectional view of the speaker in the present embodiment. More specifically, (b) in FIG. 2 is a cross-sectional view of the speaker when cut along a line defined by E-O-F shown in the plan view in (a) in FIG. 2.

As shown in FIG. 2, the speaker in the present embodiment includes: a first unit 40; a second unit 41; a first frame 42 which holds the first unit 40; a second frame 43 which holds the second frame 41; and an acoustic port 46.

A first air passage 44 is provided in the first frame 42. The first air passage 44 is provided in the same position as the air passage 35*a* in Embodiment 1. In other words, the first air passage 44 is provided so as to be disposed between two of the plural suspensions included in the first unit 40, when seen from a planar view.

Furthermore, a second air passage 45 is provided in the second frame 43. The second air passage 45 is provided so as to be disposed between two of the plural suspensions included in the second unit 41. In addition, the first air passage 44 and the second air passage 45 are connected.

The acoustic port 46 is fixed to the first frame 42 at the diaphragm-side of the first unit 40. Furthermore, a sound hole 47 is formed in a center part of the acoustic port 46.

It should be noted that the configuration of the first unit 40 and the second unit 41 are the same as that in Embodiment 1 shown in (b) in FIG. 1, and thus detailed description shall not be repeated here.

Next, the operation of the speaker configured in the manner described above shall be described.

The sound radiated to the front of the diaphragm of the first unit 40 is radiated to the outside from a sound hole 47 of the acoustic port 46, as indicated by arrow I in (b) in FIG. 2. Furthermore, the sound radiated to the front of the diaphragm of the second unit 41 passes through the second air passage 45 and the first air passage 44, and is radiated to the outside from the sound hole 47, as indicated by arrow II in (b) in FIG. 2. Furthermore, the sound radiated to the back of the diaphragm of each unit is radiated to the outside from a hole formed on a side face of the speaker, as indicated by arrows III and IV in (b) in FIG. 2.

The acoustic reproduction operation of such units is basically the same as in Embodiment 1. The speaker in the present embodiment is significantly different from the speaker in Embodiment 1 in terms of vibration characteristics. Next, such vibration characteristics shall be described.

When an electrical signal is applied to the respective voice coils of the first unit 40 and the second unit 41, the vibration direction of the respective diaphragms of the first unit 40 and the second unit 41 are vertically opposite directions as indicated by arrows 201 and 202 in (b) in FIG. 2. At this time, the phases of the sounds radiated to the front of the respective diaphragms are in-phase.

On the other hand, in each of the magnetic circuits, a reactive force is generated against the vibration direction of the diaphragm. Therefore, the vibration direction for each magnetic circuit is as indicated by arrows 203 and 204 in (b) in FIG. 2. In other words, the vibration forces of the two magnetic circuits act to cancel out each other's vibration.

Figure 3:
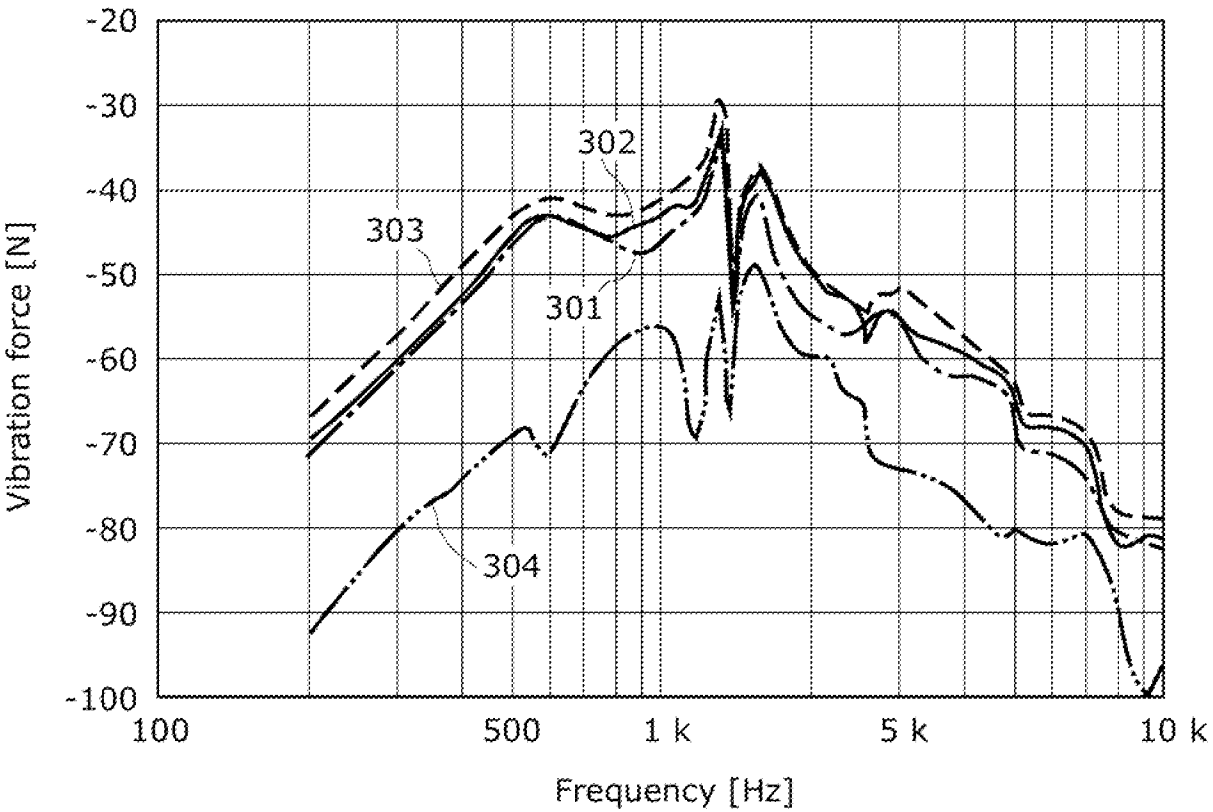
FIG. 3 is a graph of vibration force characteristics of the speaker in Embodiment 2 of the present invention.

FIG. 3 is a characteristics graph showing results for measuring the vibration forces acting on the speaker as a whole, using a dynamometer fixed to the bottom face of the speaker. The voice coil of each unit used in this measurement is a voice coil having an inner diameter of ϕ0.8 mm, a mass of 95 mg, and an electrical impedance of 36Ω. Furthermore, the diaphragm is configured of a 10 μm-thick polyimide film formed into a dome-shape. Furthermore, the material of the magnet is neodymium. In addition, the outer diameter of the magnetic circuit is ϕ5 mm.

In FIG. 3, the horizontal axis denotes frequency and the vertical axis denotes vibration force. Furthermore, vibration force is represented by a relative value. A graph 301 is the measurement result in the case where the first unit is driven independently. A graph 302 is the measurement result in the case where the second unit is driven independently. A graph 304 is the measurement result in the case where the two units are driven simultaneously. In graph 304, it can be seen that vibration force is suppressed by about 20 dB across the full bandwidth, compared to when the first unit and the second unit are driven independently.

A graph 303 denotes, for reference purposes, the measurement result in the case where the two units are driven so that the vibrations of the two units are in the same direction. In other words, the graph 303 corresponds to the measurement result in the case where the speaker in Embodiment 1 is driven. In graph 303, it can be seen that vibration force increases by about 3 dB compared to when the first unit and the second unit are driven independently.

According to the foregoing measurement results, the speaker in Embodiment 2 is capable of suppressing vibration, in addition to the same advantageous effects as the speaker in Embodiment 1. In FIG. 3, the vibration force of the speaker is reduced by 20 dB, that is, by 1/10th. With this, when a hearing aid or an earphone including the speaker in the present embodiment is worn in the external auditory canal, the unpleasantness at the time of wearing caused by the vibration of the speaker can be suppressed. In addition, a hearing aid including the speaker in the present embodiment is capable of suppressing the howling phenomenon that occurs when the vibration of the speaker is transmitted and a microphone for picking up sound vibrates.

It should be noted that the magnetizing direction of the magnetic circuit of each unit is not particularly limited; and, for example, even when the magnetic poles of the opposing magnetic circuits are in a mutually attracting direction, it is possible to obtain the same vibration suppressing effect as described above by applying an electrical signal to the voice coil such that the phases of the sounds are in phase. It is more preferable that the magnetizing direction of the electrical circuits be in a direction in which the opposing magnetic circuits repel each other, that is, it is preferable to have polarization in the direction in which N poles or S poles face each other. Specifically, it is preferable that the magnetizing directions of the magnetic circuits of the respective units be opposite each other in the diaphragm vibration direction. With this, magnetic flux that leaks from the bottom face of one of the magnetic circuits is kept inside the magnetic circuit by the repulsive magnetic field of the other magnetic circuit, and thus magnetic efficiency can be improved.

Embodiment 3

Next, Embodiment 3 of the present invention shall be described.

The difference between a speaker in the present embodiment and the speaker in Embodiment 2 lies in the arrangement direction of the first unit and the second unit. Specifically, in Embodiment 2, the bottom faces of magnetic circuits of the respective units are arranged to face each other, whereas, in the present embodiment, the diaphragms of the respective units are arranged to face each other via a spacer 54.

Hereinafter, the speaker in Embodiment 3 shall be described with reference to the Drawings.

Figure 4:
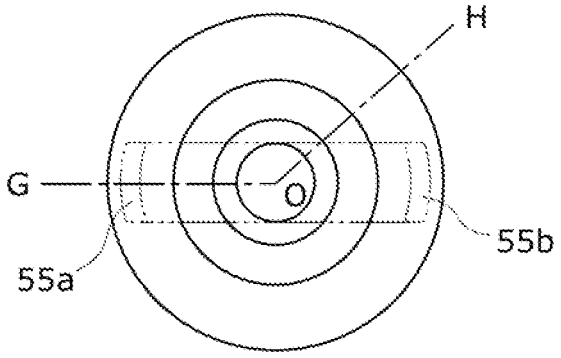
FIG. 4 is a plan view and a cross-sectional view of a speaker in Embodiment 3 of the present invention.
Figure 4:
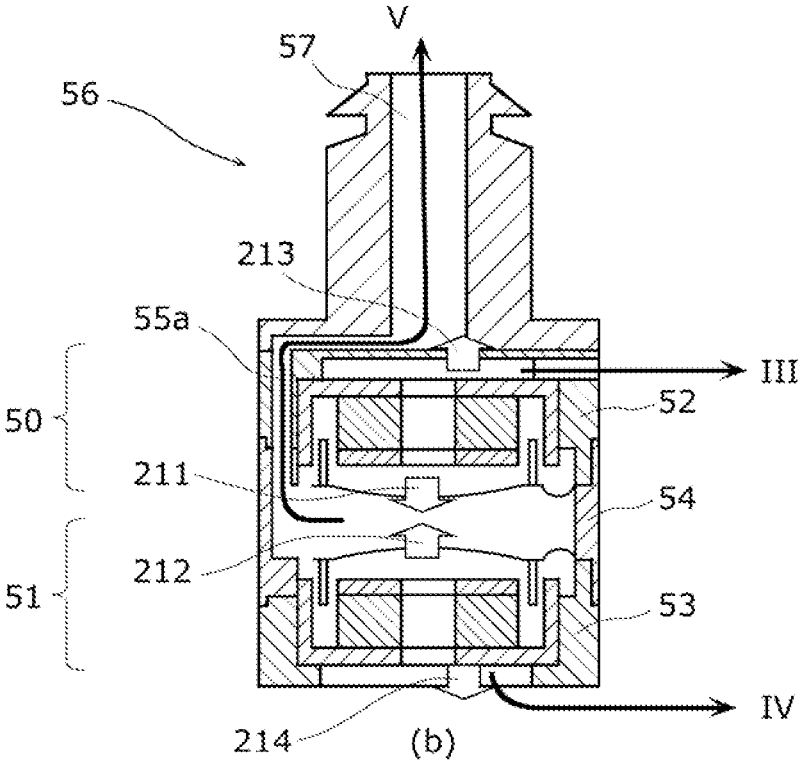

FIG. 4 is a diagram showing the speaker in Embodiment 3 of the present invention. Specifically, (a) in FIG. 4 is a plan view of the speaker in the present embodiment. Furthermore, (b) in FIG. 4 is a vertical cross-sectional view of the speaker in the present embodiment. More specifically, (b) in FIG. 4 is a cross-sectional view of the speaker when cut along a line defined by G-O-H shown in the plan view in (a) in FIG. 4.

As shown in FIG. 4, the speaker in the present embodiment includes: a first unit 50; a second unit 51; a first frame 52 which holds the first unit 50; a second frame 53 which holds the second frame 51; the spacer 54 provided between the first frame 52 and the second frame 53; and an acoustic port 56.

Air passages 55*a* and 55*b* are provided in the first frame 52. The air passages 55*a* and 55*b* are provided in the same position as the air passage 35*a* in Embodiment 1. Specifically, in the same manner as in Embodiments 1 and 2, the air passages 55*a* and 55*b* are provided in between plural suspensions each of which supports a different position in the outer periphery of the diaphragm of the first unit.

The acoustic port 56 is fixed to the first frame 52 at the magnetic circuit-side of the first unit 50. Furthermore, a sound hole 57 is formed in a center part of the acoustic port 56.

Next, the operation of the speaker configured in the manner described above shall be described.

When an electrical signal is applied to the voice coil of the first unit 50 and to the voice coil of the second unit 51, each diaphragm vibrates and sound is radiated, as in Embodiments 1 and 2. The sounds radiated to the front of each diaphragm are combined into one inside the speaker, as indicated by arrow V in (b) in FIG. 4. The sound obtained through such a combination passes through the air passages 55*a* and 55*b* provided in the first frame 52, and is radiated to the outside from the sound hole 57. Furthermore, the sound radiated to the back of each diaphragm is radiated to the outside space, as indicated by arrows III and IV in (b) in FIG. 4.

As described above, a significant difference between the present embodiment and Embodiments 1 and 2 lies in the manner in which the sounds radiated from the respective diaphragms of the first and second units are combined. In previously described Embodiments 1 and 2, the sound from the two units which is outputted from the speaker is the combination of the sound from the first unit which is outputted directly to the acoustic port (arrow I) and the sound from the second unit which passes through the air passage provided in the first frame or the first and second frames (arrow II). With this, in Embodiments 1 and 2, there is the problem that a passage difference, that is, a phase difference occurs between the sound from the first unit and the sound from the second unit, and thus the sounds interfere with each other.

In contrast, in the present embodiment, the sounds outputted from the two units pass through a common air passage, and are radiated from the sound hole 57 formed in the acoustic port 56. Therefore, with the reproduced sound of the speaker in the present embodiment, a phase difference as in the speaker in Embodiments 1 and 2 does not occur, and the sound pressure frequency characteristics particularly in the high frequencies is improved and reproduced sound having higher quality can be realized.

In addition, in the present embodiment, the vibrations of the magnetic circuits receiving the reactive force of the vibrations of the diaphragms (arrows 211 and 212) are mutually canceled out as indicated by arrows 213 and 214 in (b) in FIG. 4. As such, the speaker in the present embodiment can suppress the vibrations in the speaker as a whole, in the same manner as in Embodiment 2. Furthermore, the magnetizing direction of the magnetic circuits may be set arbitrarily. At this time, it is preferable that each of the units be arranged such that same poles face each other such that the magnetic circuits repel each other. With this, the magnetic fluxes that would leak from the diaphragm-side of the respective magnetic circuits are contained by each other's magnetic repulsion, and thus it becomes possible to raise the magnetic flux of the magnetic air gap into which the voice coil is inserted, and improve the sound pressure level.

It should be noted that although in the present embodiment the second unit 51 includes plural suspensions each of which supports a different position in the outer periphery of the diaphragm, the second unit 51 need not necessarily include plural suspensions in the above described manner. The second frame 53 need not be provided with an air passage for channeling the sound outputted from the second unit 51 to the acoustic port 56. For this reason, the second unit 51 may include one suspension which supports the entirety of the outer periphery of the diaphragm.

Embodiment 4

Next, Embodiment 4 of the present invention shall be described.

A speaker in the present embodiment is different from the speaker in Embodiment 1 in that two sound holes are formed, in the acoustic port, for independently radiating the respective sounds outputted from the two units, to the outside.

Hereinafter, the speaker in Embodiment 4 shall be described with reference to the Drawings.

Figure 5:
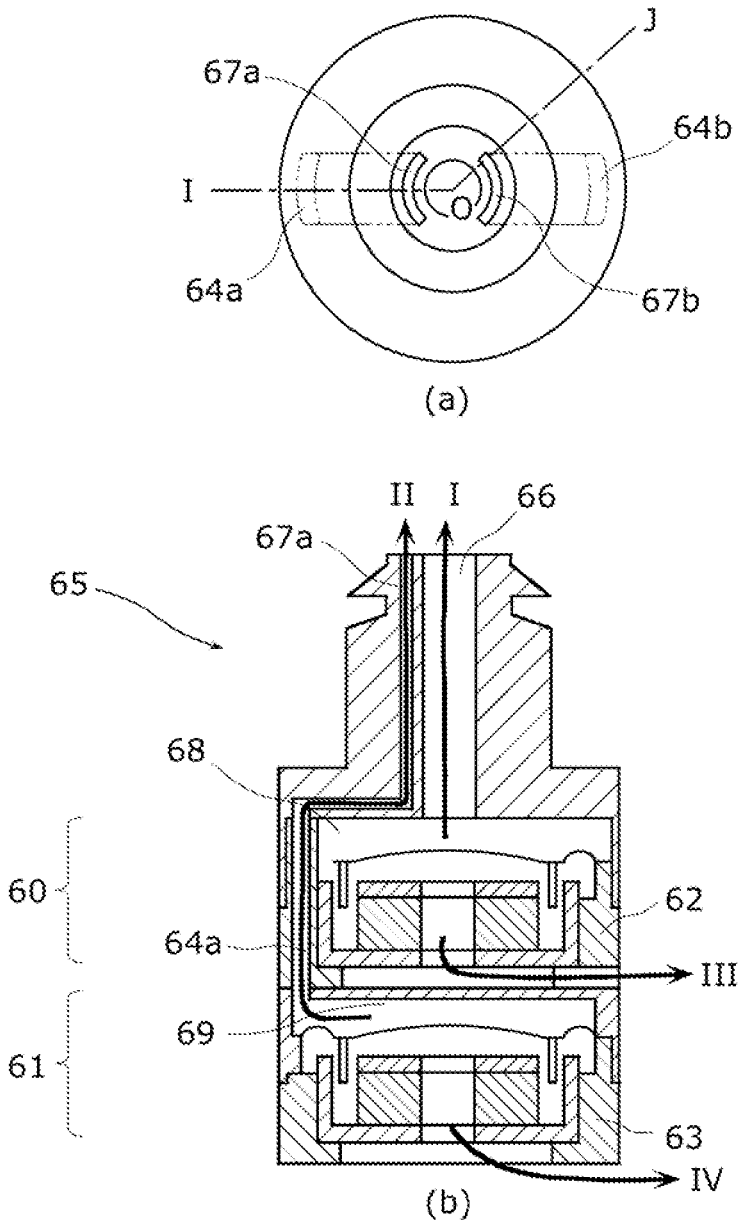
FIG. 5 is a plan view and a cross-sectional view of a speaker in Embodiment 4 of the present invention.

FIG. 5 is a diagram showing the speaker in Embodiment 4 of the present invention. Specifically, (a) in FIG. 5 is a plan view of the speaker in the present embodiment. Furthermore, (b) in FIG. 5 is a vertical cross-sectional view of the speaker in the present embodiment. More specifically, (b) in FIG. 5 is a cross-sectional view of the speaker when cut along a line defined by I-O-J shown in the plan view in (a) in FIG. 5.

As shown in FIG. 5, the speaker in the present embodiment includes: a first unit 60; a second unit 51; a first frame 62 which holds the first unit 60; a second frame 63 which holds the second frame 61; and an acoustic port 65.

Air passages 64*a* and 64*b* are provided in the first frame 62. Furthermore, a first sound hole 66 and second sound holes 67*a* and 67*b* are provided in the acoustic port 65.

A first air chamber 68 is formed in front of the diaphragm of the first unit 60. The first air chamber 68 is connected to the first sound hole 66. Therefore, the sound radiated to the front of the diaphragm of the first unit 60 is radiated to the outside by sequentially passing through the first air chamber 68 and the first sound hole 66.

Furthermore, a second air chamber 69 is formed in front of the diaphragm of the second unit 61. The second air chamber 69 is connected to the second sound holes 67*a* and 67*b* via the air passages 64*a* and 64*b*. Therefore, the sound radiated to the front of the diaphragm of the second unit 61 is radiated to the outside by sequentially passing through the second air chamber 69, the air passages 64*a* and 64*b*, and the second sound holes 67*a* and 67*b*.

Figure 6:
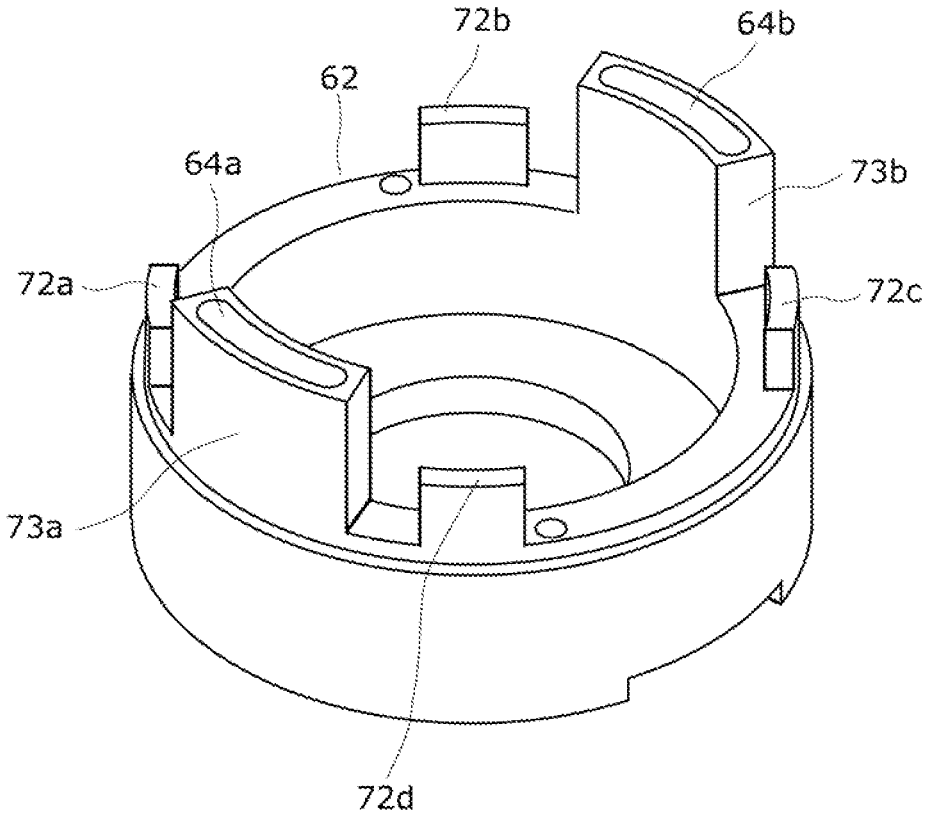
FIG. 6 is an external view of a frame in Embodiment 4 of the present invention.

FIG. 6 is an external view of the first frame 62 in Embodiment 4 of the present invention. The joined state of the air passages 64*a* and 64*b* provided in the first frame 62 and the second sound holes 67*a* and 67*b* formed in the acoustic port 65 shall be described using FIG. 6.

The first frame 62 includes support mountings 72*a*, 72*b*, 72*c*, 72*d*, and pillars 73*a* and 73*b*. The outer edges of the plural suspensions which support, at mutually different positions, the outer periphery of the diaphragm of the first unit 60 are fixed to the support mountings 72*a*, 72*b*, 72*c*, 72*d*.

The pillars 73*a* and 73*b* form the air passages 64*a* and 64*b* between the suspensions. The respective upper end parts of the pillars 73*a* and 73*b*, are joined with the lower end parts of the second sound holes 67*a* and 67*b* of the acoustic port 65.

Next, the operation of the speaker configured in the manner described above shall be described.

A significant difference between the present embodiment and Embodiment 1 is that the sound radiated to the front of the diaphragm of the first unit 60 is radiated from the first sound hole 66 formed in the acoustic port 65 and the sound radiated to the front of the diaphragm of the second unit 61 is radiated from the second sound holes 67*a* and 67*b* formed in the acoustic port 65 via the air passages 64*a* and 64*b* provided in the first frame 62. With this, the sounds radiated to the front of the respective diaphragms are separated from each other until they are radiated to the outside from the acoustic port 65.

Here, the sound radiated to the front of the diaphragm of the first unit 60 generates a first acoustic resonance which is dependent on the acoustic stiffness of the first air chamber 68 formed in front of the diaphragm and the acoustic mass of the first sound hole 66 formed in the acoustic port 65. In the same manner, the sound radiated to the front of the diaphragm of the second unit 61 generates a second acoustic resonance which is dependent on the acoustic stiffness of the second air chamber 69 formed in front of the diaphragm and the acoustic mass of the second sound holes 67*a* and 67*b* formed in the acoustic port 65.

In view of this, in the present embodiment, the first air chamber 68, the second air chamber 69, the first sound hole 66, and the second sound holes 67*a* and 67*b* are formed such that the first acoustic resonance and the second acoustic resonance have different frequencies. Specifically, the first air chamber 68, the second air chamber 69, the first sound hole 66, and the second sound holes 67*a* and 67*b* are formed such that the (i) first acoustic resonance which is dependent on the acoustic capacitance of the first air chamber 68 and the acoustic mass of the first sound hole 66 and (ii) the second acoustic resonance which is dependent on the acoustic capacitance of the second air chamber 69 and the acoustic mass of the second sound holes 67*a* and 67*b* have different frequencies.

Figure 7:
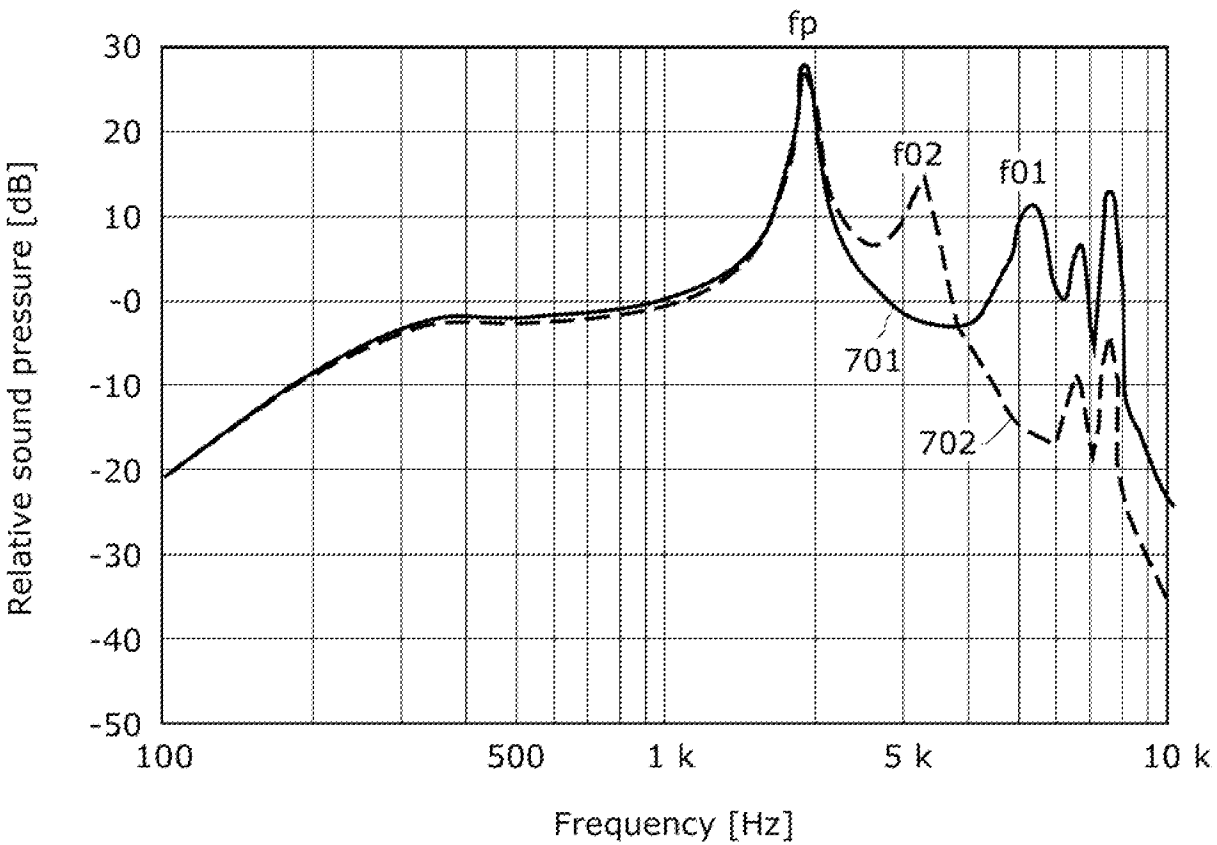
FIG. 7 is a graph of sound pressure frequency characteristics of the speaker in Embodiment 4 of the present invention.

FIG. 7 is a graph showing results of measuring acoustic characteristics of the speaker in Embodiment 4 of the present invention. In such measurement of acoustic characteristics, measurement was carried out by placing a microphone in one end of an sound tube with an inner diameter of ϕ13 mm and a length of 25 mm which is equivalent to an external auditory canal, and attaching, to the other end, the speaker in the present embodiment having a main body with an outer diameter of ϕ6.5 mm and the acoustic port with an outer diameter of ϕ4 mm and a length of 4 mm.

Here, the measurement results for the low frequencies of the sound pressure frequency characteristics varies significantly depending on whether the connection with the measuring sound tube is sealed or open. When a hearing aid or earphone is to be used for a long period of time, a hearing aid or earphone of the open type which allows outside air to pass through the ear canal is preferable. In view of this, here, measurement is carried out for an open headphone or earphone by providing an air gap between the inner wall of the external auditory canal and the speaker.

In FIG. 7, graph 701 denotes sound radiated to the front of the diaphragm of the first unit 60. Furthermore, graph 702 denotes sound radiated to the front of the diaphragm of the second unit 61. The sound pressure peak fp in the neighborhood of 2 kHz represents the resonance of the measuring sound tube. In both graphs 701 and 702, the resonance of the measuring sound tube occurs at the same frequency.

Meanwhile, as shown in graph 701, a second sound pressure peak occurs in the neighborhood of 7.3 kHz (f01) with the sound radiated to the front of the diaphragm of the first unit 60. This peak represents an acoustic resonance according to the acoustic stiffness of the first air chamber 68 formed in front of the diaphragm of the first unit 60 and the acoustic mass of the first sound hole 66. Furthermore, as shown in graph 702, a second sound pressure peak occurs in the neighborhood of 5.3 kHz (f02) with the sound radiated to the front of the diaphragm of the second unit 61. This peak represents an acoustic resonance according to the acoustic stiffness of the second air chamber 69 formed in front of the diaphragm of the second unit 61 and the acoustic mass of the second sound holes 67*a* and 67*b*.

By simultaneously applying the same electrical signal to the two units, the sound pressure peak is added in the two acoustic resonance frequencies f01 and f02 described above. Therefore, at a high frequency of 2 kHz or higher, the sound pressure frequency characteristics of the combined sound of the sound outputted from the first unit 60 and the sound outputted from the second unit 61 enable the realization of a high sound pressure level over a wide bandwidth compared to, for example, when the acoustic resonance is set outside the reproduction bandwidth or when the two resonances are set at approximately the same frequency.

It should be noted that although in the present embodiment the suspension supporting the diaphragm of the second unit 61 is configured as a single suspension so as to support the entirety of the outer periphery of the diaphragm, the suspension may be configured as plural suspensions each supporting a different position in the outer periphery of the diagram as in Embodiments 1 and 2. The sound pressure characteristics shown in FIG. 7 are the measuring results in the measurement of a speaker in which the second unit 61 includes plural suspensions for making the low frequency characteristics of the two units uniform.

Furthermore, as a means for setting the two acoustic resonances f01 and f02, it is sufficient, for example, to adjust the cross-sectional surface area or the length of the respective holes formed in the acoustic port 65. Alternatively, it is sufficient to adjust the volumetric capacity of the first air chamber 68 and the second air chamber 69 which are formed in front of the respective diaphragms. By doing so, random frequencies can be set as the acoustic resonance frequencies. In particular, in a receiver for use in a hearing aid, it is preferable to set the frequency of at least one acoustic resonance in the neighborhood of 3 kHz to 4 kHz in order to improve sound clarity.

Embodiment 5

Next, an example in which a speaker according to an aspect of the present invention is provided in a device shall be described. First, in Embodiment 5, an example in which a speaker is provided in a hearing aid shall be described.

Figure 8:
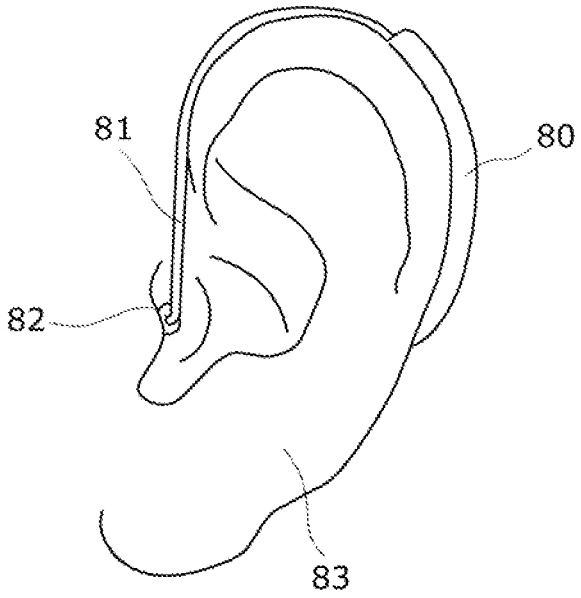
FIG. 8 is an external view of a hearing aid in Embodiment 5 of the present invention at the time of wearing.
Figure 9:
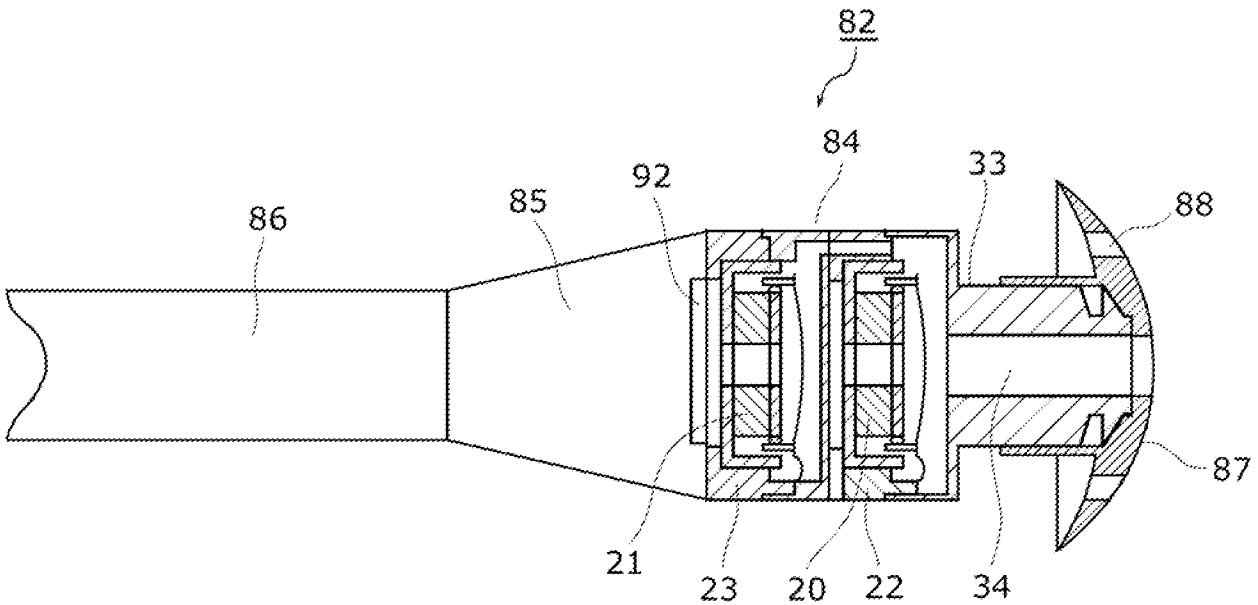
FIG. 9 is a detailed diagram of a receiver unit in Embodiment 5 of the present invention.
Figure 10:
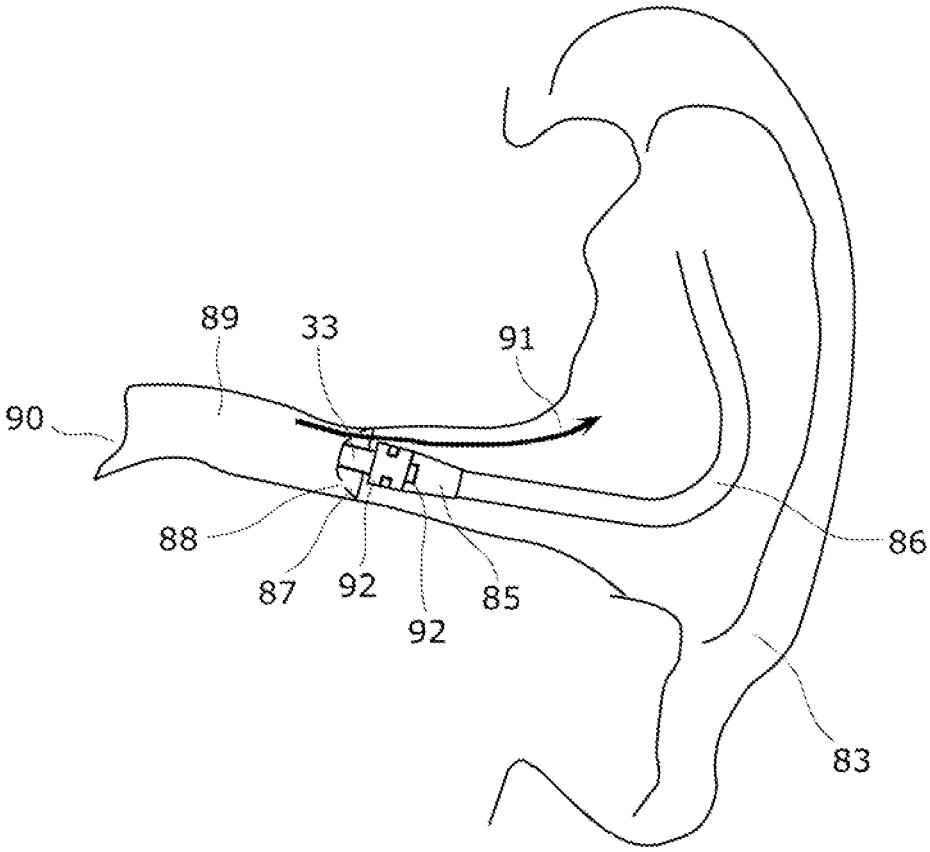
FIG. 10 is a diagram showing the worn state of the receiver unit in Embodiment 5 of the present invention.

FIG. 8 is an external view of a hearing aid in Embodiment 5 of the present invention. Furthermore, FIG. 9 is a detailed diagram of the hearing aid in Embodiment 5 of the present invention. Furthermore, FIG. 10 is a detailed diagram for a case where a receiver unit of the hearing aid in Embodiment 5 of the present invention is worn in the external auditory canal of an ear.

As shown in FIG. 8, the hearing aid is used by being inserted into the external auditory canal of an ear 83. The hearing aid includes a hearing aid body 80, a lead tube 81, and a receiver 82.

The hearing aid body 80 includes a signal processing unit which converts, into an electrical signal, the sound of a speaker's voice collected by a microphone, and optimizes characteristics of the sound in accordance with the hearing characteristics of a user. The lead tube 81 includes, internally, an electrical wire by which an electrical signal is transmitted. The receiver 82 converts the electrical signal transmitted from the lead tube 81 into sound.

The receiver 82 shall be described in detail using FIG. 9. A speaker unit 84 which is the main body of the receiver 82 has the same configuration as the speaker shown in Embodiment 1, and thus components that are the same as the components shown in FIG. 1 are given the same reference numerals.

A lead tube connection 85 is attached to the second frame 32 supporting the second unit 21, and is joined to the lead tube 86. In the lead tube connection 85, a sound hole 92 is formed for releasing sound radiated from the back face of the diaphragm of the second unit 21. An ear tip 87 in which an air passage hole 88 is formed is attached to the acoustic port 33.

The speaker unit 84 which is the main body of the receiver 82 is connected to a lead wire inside the lead tube 86, and converts the electric signal transmitted from the lead wire into reproduced sound.

A worn state in which the receiver 82 of the hearing aid is inserted in the external auditory canal of the ear shall be described using FIG. 10. As shown in FIG. 10, the receiver 82 is inserted inside an external auditory canal 89 of the ear 83. At this time, what is in contact with the inner wall surface of the external auditory canal 89 is the ear tip 87 attached to the tip of the acoustic port 33.

As described in Embodiment 4, the receiver 82 of the hearing aid can be divided into two types depending on the manner of insertion to the ear hole, namely, the sealed type in which no gap is formed with the inner wall surface of the external auditory canal, and the open type which has an air passage hole. The receiver 82 in the present embodiment is an open receiver in which the air passage hole 88 is formed in the ear tip 87.

Next, the advantageous effects when a speaker according to an aspect of the present invention is used in the receiver which is a sound reproduction speaker of the hearing aid shall be described in detail.

The hearing aid assists the hearing of a user by delivering the sound radiated from the receiver 82 to an eardrum 90. Part of the sound radiated from the receiver 82 is channeled to the outside air via the air passage hole 88 formed in the ear tip 87, thereby creating a leaked sound 91. As such, generally, in an open hearing aid, the sound pressure level deteriorates at a low frequency of 1 kHz or lower.

On the other hand, in the hearing aid in the present embodiment, the diaphragms of the two units are supported by plural suspensions having little stiffness, as described in Embodiment 1. As such, the minimum resonance frequency of the respective units can be reduced up to the neighborhood of 300 Hz. As such, in the hearing aid in the present embodiment, even in an open hearing aid, reproduction is possible without deterioration in sound pressure level even up to the low frequencies. In other words, the hearing aid in the present embodiment is capable of reproducing sound of high sound quality.

Furthermore, since two units are used in the hearing aid in the present embodiment, reproduction sound pressure becomes highly-efficient. In other words, sufficient sound volume can be obtained even with a small input signal, and thus battery consumption can be suppressed. In addition, the sound outputted from the second unit 21 is channeled to the outside by air passages provided between the plural suspensions each of which holds a part of the outer periphery of the diaphragm of the first unit 20. As such, even when the hearing aid includes two units, it is possible to keep the external dimensions of the receiver 82 from becoming big. As a result, insertion of the receiver 82 into the external auditory canal is facilitated and, at the same time, the external auditory canal is not blocked by the presence of the receiver itself and the air passage hole of the ear tip allows the air around the ear drum to easily circulate with the outside air, and thus comfortable wearing over a long period of time can be realized.

It should be noted that although a hearing aid that includes the speaker in Embodiment 1 is described in the present embodiment, it should be obvious that the hearing aid may include any of the speakers in Embodiments 2 to 4.

Furthermore, although a hearing aid is described in the present embodiment, the speaker in any Embodiments 1 to 4 may be provided in an inner ear earphone for reproducing music or voice, which is attached to a portable device such as a music player or a cellular phone equipped with a TV function. In this case, although most current inner ear earphones are of the sealed type, the present invention is capable of realizing a high sound quality, open inner ear earphone which is capable of sufficient reproduction even in the low frequencies and can be worn for a long period of time without user fatigue.

Embodiment 6

Figure 11:
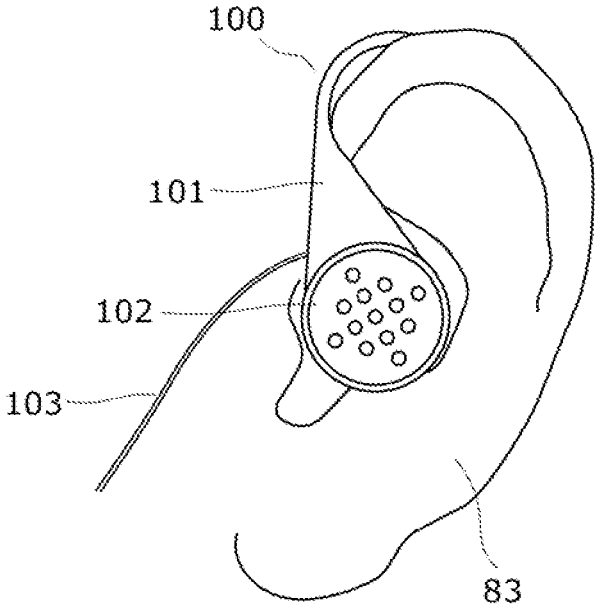
FIG. 11 is an external view of a headphone in Embodiment 6 of the present invention at the time of wearing.

Next, an example in which a speaker according to an aspect of the present invention is provided in a headphone shall be described. FIG. 11 is an external view of an earhook-type headphone in Embodiment 6 of the present invention at the time of wearing. As shown in FIG. 11, the headphone in the present embodiment includes: a headphone body 100; an earhook holder 101 which holds the headphone in a gape between the ear and the head; a receiver 102 which is held at the end of the earhook holder and includes a speaker according to an aspect of the present invention; and a cord 103 which transmits an electrical signal to the receiver 102. It should be noted that, in the present embodiment, the receiver 102 is not inserted inside the external auditory canal and is placed in the vicinity of the opening of the external auditory canal.

Next, the advantageous effects when a speaker according to an aspect of the present invention is used in a receiver for a headphone shall be described. Details of the receiver 102 overlap with those in Embodiment 5, and thus description shall not be repeated here. The speaker used in the present embodiment may be any of the speakers in Embodiments 1 to 4. Since the projecting part of the acoustic port becomes a hindrance when the receiver 102 is placed at the entrance of the external auditory canal, it is preferable to have a speaker in which such projecting part is shortened or eliminated.

Here, the receiver 102 is loosely supported by the earhook holder 101. Therefore, a gap that is large enough for sound leakage is formed between the receiver 102 and the opening part of the external auditory canal. However, in the speaker according to an aspect of the present invention, the diaphragms of the two units are supported by plural suspensions. As such, the minimum resonance frequency of the respective units can be reduced up to the neighborhood of 100 Hz. As a result, it is possible to realize a high sound quality headphone in which the sound radiated from the receiver 102 is reproduced up to the low sound frequencies even when the sound leaks to the outside at the opening of the external auditory canal. Furthermore, the receiver 102 is not inserted inside the external auditory canal thereby allowing implementation as an open earphone which allows wearing over a long period of time.

It should be noted that although, in the present embodiment, the speaker according to an aspect of the present invention is provided in an earhook headphone, the speaker may be provided in a head-mounted display (HMD) or 3D viewing glasses, and so on. In these cases, it is possible to easily realize a high sound quality device that reproduces powerful low pitch sound, and imparts minimal fatigue even when worn for a long period of time.

Embodiment 7

Figure 12:
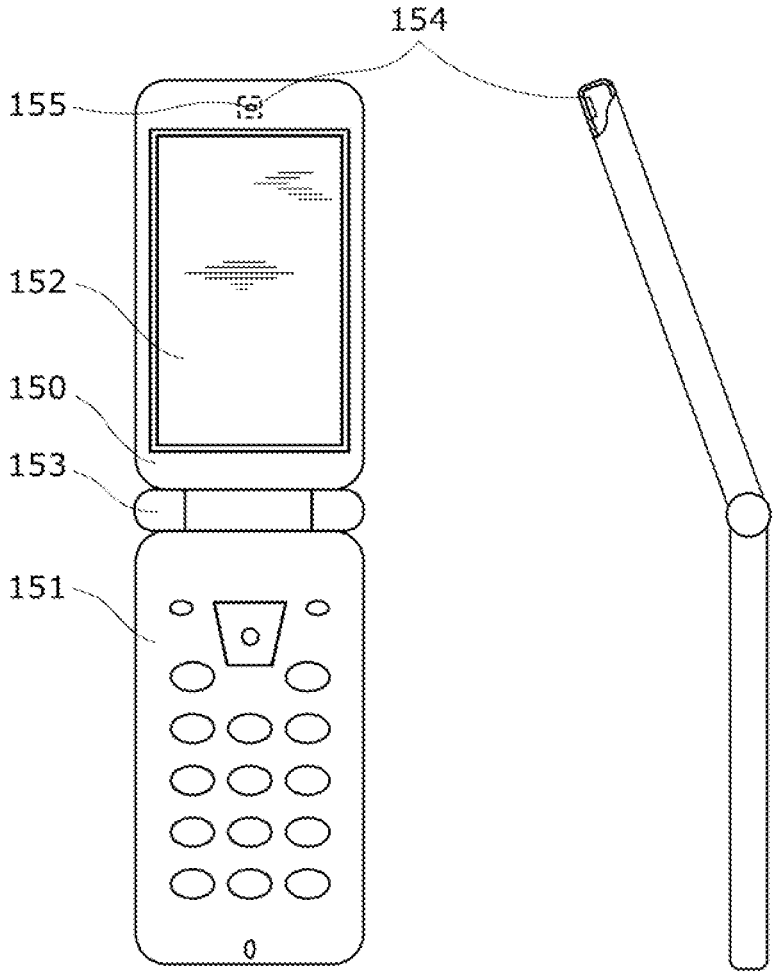
FIG. 12 is an external view of a portable terminal device in Embodiment 7 of the present invention.

Next, an example in which a speaker according to an aspect of the present invention is provided in a portable terminal device shall be described. FIG. 12 is an external view of a portable terminal device according to Embodiment 5 of the present invention.

The portable terminal device in the present embodiment includes an upper housing 150, a lower housing 151, a liquid crystal screen 152, a hinge 153, and a speaker 154. Furthermore, a sound hole 155 is formed in the upper housing 150. The portable terminal device shown in FIG. 12 is a folding-type cellular phone having a main body configured of the upper housing 150 and the lower housing 151. The upper housing 150 and the lower housing 151 are rotatably connected, with the hinge 153 as a center.

The liquid crystal screen 152 is provided at the front face of the upper housing 150. The speaker 154 is disposed inside the upper housing 150, at the top end of the liquid crystal screen 152. It should be noted that the speaker 154 is the same as any of the speakers in Embodiments 1 to 4.

The operation of the portable terminal device configured in the manner described above shall be described. Although not illustrated here, when a reception signal is received from an antenna, the reception signal that has been processed by the signal processing unit is inputted to the speaker 154, and the sound of the received call is reproduced. Specifically, the speaker 154 in the present embodiment is a speaker that reproduces the sound of a received call in the cellular phone, and operates as an acoustic transducer called a receiver.

As described above, the portable terminal device in the present embodiment includes a speaker which is miniaturized and at the same time suppresses deterioration of acoustic efficiency, and thus the portable terminal device can be miniaturized and reduced power consumption can also be realized.

Although the speaker according to an aspect of the present invention has been described thus far based on the embodiments, the present embodiment is not limited to these embodiments. Various modifications to the present embodiments that may be conceived by a person of ordinary skill in the art or those forms obtained by combining constituent elements in the different embodiments, for as long as they do not depart from the essence of the present invention, are intended to be included in the scope of this invention.

For example, although the speaker includes magnetic fluid in the above-described embodiments, the speaker need not necessarily include magnetic fluid. For example, the speaker may have, in the respective units, a structure which allows the air chamber formed in front of the diaphragm and the air chamber formed behind the diaphragm to be physically blocked.

INDUSTRIAL APPLICABILITY

The present invention described above allows the realization of a miniaturized high-efficiency speaker, and is thus useful as a speaker provided in an earphone, a hearing aid, or a portable terminal device, and so on.

The invention claimed is:

1. A speaker comprising:

a first unit; and a second unit, each of said first unit and said second unit being configured to output sound, wherein said first unit includes a first diaphragm configured to vibrate back and forth so as to radiate sound, and a plurality of suspensions supporting an outer periphery of said first diaphragm at mutually different positions, wherein said plurality of suspensions include a first suspension and a second suspension disposed next to each other in an outer periphery direction of said first diaphragm, an air passage is configured to channel sound outputted from said second unit to the outside, said air passage being disposed between said first suspension and said second suspension, said second unit includes a second diaphragm configured to vibrate back and forth so as to radiate the sound, said first diaphragm and said second diaphragm are arranged in series such that at least part of a membrane surface of one of said first and second diaphragms overlaps with at least part of a membrane surface of the other of said first and second diaphragms, when seen from a vibration direction of said first diaphragm or said second diaphragm, a first sound hole and a second sound hole are disposed in an acoustic port, the sound radiated from said first diaphragm is radiated from the first sound hole, and the sound radiated from said second diaphragm is radiated from the second sound hole, via the at least one air passage.

2. The speaker according to claim 1, further comprising an acoustic port through which sound is capable of being radiated to the outside, wherein said first unit is disposed between said acoustic port and said second unit, the sound radiated to a front of said first diaphragm is radiated to the outside through said acoustic port, and the sound radiated to a front of said second diaphragm passes through the at least one air passage, and is radiated to the outside through said acoustic port.

3. The speaker according to claim 1, wherein a first air chamber is disposed in front of said first diaphragm, a second air chamber is disposed in front of said second diaphragm, and the first air chamber, the second air chamber, the first sound hole, and the second sound hole are configured such that a first acoustic resonance and a second acoustic resonance have mutually different frequencies, the first acoustic resonance being dependent on an acoustic capacitance of the first air chamber and an acoustic mass of the first air hole, and the second acoustic resonance being dependent on an acoustic capacitance of the second air chamber and an acoustic mass of the second air hole.

4. A speaker comprising:

a first unit; and a second unit, each of said first unit and said second unit being configured to output sound, wherein said first unit includes a first diaphragm configured to vibrate back and forth so as to radiate sound, and a plurality of suspensions supporting an outer periphery of said first diaphragm at mutually different positions, wherein said plurality of suspensions include a first suspension and a second suspension disposed next to each other in an outer periphery direction of said first diaphragm, an air passage is configured to channel sound outputted from said second unit to the outside, said air passage being disposed between said first suspension and said second suspension, said second unit includes a second diaphragm configured to vibrate back and forth so as to radiate the sound, said first diaphragm and said second diaphragm are arranged in series such that at least part of a membrane surface of one of said first and second diaphragms overlaps with at least part of a membrane surface of the other of said first and second diaphragms, when seen from a vibration direction of said first diaphragm or said second diaphragm, and the respective vibration directions of said first diaphragm and said second diaphragm are opposite directions.

5. The speaker according to claim 4, wherein each of said first unit and said second unit is an electrodynamic electro-acoustic transducer including a magnetic circuit, and a magnetizing direction of said magnetic circuit of said first unit and a magnetizing direction of said magnetic circuit of said second unit are mutually opposite in the vibration direction of said diaphragms.

6. The speaker according to claim 5, wherein said first unit and said second unit are arranged such that a bottom face-side of said magnetic circuit of said first unit and a bottom face-side of said magnetic circuit of said second unit face each other.

7. The speaker according to claim 5, wherein said first unit and said second unit are arranged such that said first diaphragm and said second diaphragm face each other.

8. A speaker comprising:

a first unit; and a second unit, each of said first unit and said second unit being configured to output sound, wherein said first unit includes a first diaphragm configured to vibrate back and forth so as to radiate sound, and a plurality of suspensions supporting an outer periphery of said first diaphragm at mutually different positions, wherein said plurality of suspensions include a first suspension and a second suspension disposed next to each other in an outer periphery direction of said first diaphragm, an air passage is configured to channel sound outputted from said second unit to the outside, said air passage being disposed between said first suspension and said second suspension, a first air chamber is in front of said first diaphragm, a second air chamber is in front of said second diaphragm, a sound hole is in an acoustic port, the sound hole is connected to the first air chamber, and is connected to the second air chamber via the at least one air passage, and the sound radiated to the back of said first diaphragm and the sound radiated to the back of said second diaphragm are radiated in a direction different from a direction of sound radiated from the sound hole.

9. The speaker according to claim 5, wherein a magnetic fluid is in a magnetic air gap in said magnetic circuit of said first unit and has a voice coil inserted therein.

10. A hearing aid or an earphone comprising said speaker according to claim 1.

11. The hearing aid or the earphone according to claim 10, further comprising an ear tip at an exit-side of an acoustic port.

12. The hearing aid or the earphone according to claim 11, wherein an air passage hole is in said ear tip, and is configured to enable air inside an external auditory canal to pass to the outside.

13. A portable terminal device comprising the speaker according to claim 1.

* * * * *